US005410954A

United States Patent [19]

Wygal et al.

[11] Patent Number: 5,410,954

[45] Date of Patent: May 2, 1995

[54] THREE DIMENSIONAL AUTOMATIC FOOD SLICER

[75] Inventors: Garold L. Wygal, Durham; Dennis Z. Rush, Warrenton; Peter D. Johnson, Seaside; Paul S. Anderson, Astoria, all of Oreg.

[73] Assignee: Carruthers Equipment Co., Warrenton, Oreg.

[21] Appl. No.: 63,402

[22] Filed: May 17, 1993

Related U.S. Application Data

[63] Continuation-in-part of Ser. No. 876,123, Apr. 29, 1992, Pat. No. 5,271,304.

[51] Int. Cl.[6] ..... B26D 3/18

[52] U.S. Cl. ..... 99/537; 99/538; 83/404.2; 83/404

[58] Field of Search ..... 99/537, 538, 567, 485, 99/486; 83/404, 404.1, 404.2

[56] References Cited

U.S. PATENT DOCUMENTS

| | | | |
|---|---|---|---|
| 1,910,096 | 5/1933 | Egan et al. | 83/404.2 |
| 2,161,891 | 6/1939 | Spang | 83/404.2 |
| 2,541,180 | 2/1951 | Urschel et al. | 83/403 X |
| 3,841,186 | 10/1974 | Demerin | 83/404.2 |
| 4,163,406 | 8/1979 | Crawford | 83/424 |
| 4,329,900 | 5/1982 | Dennis et al. | 83/355 |
| 4,782,729 | 11/1988 | Mathot | 83/408 |
| 4,796,821 | 1/1989 | Pao et al. | 83/356.2 X |
| 4,909,139 | 3/1990 | Montano et al. | 99/537 |
| 5,050,492 | 9/1991 | Wotton et al. | 99/537 X |
| 5,271,304 | 12/1993 | Wygal et al. | 83/422 |

*Primary Examiner*—David A. Scherbel
*Assistant Examiner*—Patrick F. Brinson
*Attorney, Agent, or Firm*—Robert L. Harrington

[57] ABSTRACT

A machine for slicing a food product in the three dimensions in a single continuous cycle to produce an end product having a determined size and shape. The machine incorporates a first slicing station for slicing a determined length of a first slice off the food product by a first cutoff knife and a second slicing station to slice the first slice in two dimensions by a set of gang knives and a second cut off knife to produce a cube of a determined size and shape. The machine has a conveyor system for conveying the food product on a continuous basis through the machine. The rotation of the cut off knives are variable to establish the desired dimensions of the end product. The first slice is transferred on the conveyor of the second slicing station in a manner to accommodate slicing the first slice in the other two dimensions by the second slicing station.

11 Claims, 4 Drawing Sheets

THREE DIMENSIONAL AUTOMATIC FOOD SLICER

This is a continuation-in-part of application Ser. No. 07/876,123, filed Apr. 29, 1992, now U.S. Pat. No. 5,271,304.

FIELD OF THE INVENTION

This invention relates to the slicing of a food product, e.g., a log or loaf of meat into determined cube shapes and more particularly to a continuous feed automatic slicer that is capable of slicing food products into cubes of the a desired height, width and length.

BACKGROUND OF THE INVENTION

Automatic two dimensional food slicers are known to provide the capability of feeding food products into the path of cutting blades to simultaneously cut the food product into multiple widths and lengths. A machine of this type is disclosed in the commonly assigned U.S. application Ser. No. 07/876,123, now U.S. Pat. No. 5,271,304. The height of the end product was determined by the height of food product when fed into the slicer. If the height of the food product was greater than the desired height of the end product, a separate slicing or cutting operation was required before the food product was fed into the automatic two dimensional food slicer. The separate operation involved separate and additional handling of the food product. Rarely would the operation of the separate operation be scheduled or completed in conformance with the requirements of the two dimensional slicing.

Prior attempts have been made to produce a three dimensional cut in one operation by attempting to force the food product through a grid work of knives that were arranged similar to the well known vegetable slicer such as is used to produce potato french fries. As the product exited the grid work, another knife would cut the pieces to length. As far as is known this has proved unsuccessful, due in part to the lack or rigidity of the food products.

BRIEF SUMMARY OF THE INVENTION

The present invention utilizes proven technology for slicing such food products and arranges features of this technology in a unique manner to accomplish the desired objective of slicing a food product in three dimensions to provide a desired end product having a determined length, width and height.

The automatic food slicers utilize a pivoting or rotating cross cutting blade that slices the length of a food product, such as a food product loaf, into multiple slabs having determined lengths. The width and height of the slab is still determined by the original dimension of the food product being sliced.

Such a slicer, hereafter referred to as a first slicer, is arranged in a preferred embodiment for cutting a loaf into multiple pieces, each having a determined length to produce a desired height of the end product (cube). The first slicer is arranged in a manner to discharge the slab onto a conveyor of a second slicer with the length dimension of the slab substantially normal to the face of the loaf from which it was cut. The slab as it is severed from the loaf is tipped on to the conveyor of the second slicer. The length dimension of the slab on the conveyor of the second slicer may now be considered the determined height of the desired end product (cube). The length of the slab on the second conveyor is measured along the direction of travel of the conveyor with the width of the slab being measured transverse to the travel direction of the conveyor. The conveyor feeds the slab into and through the knives of the second slicer. The second slicer has a gang of circular rotating knives in line with the conveyor and thus in the travel path of the loaf. A pivoting or rotating cut off knife is mounted strategic to the conveyor and gang knives that has a portion of its travel path being between the end of the conveyor and the gang knives. The gang knives make multiple cuts in the slab of determined spacing as the loaf is fed into the gang knives and the cross cut knife cuts the portion of the slab fed into the gang knives at a determined length. The automatic food slicer of the present invention thus slices a food product loaf into cube like forms that have a uniformity of size and shape.

The present invention has conveyors for the first and second slicing machine that grip the food product to ensure proper feeding of the food product through the knives. The conveyors are arranged to accurately feed the food product to produce the desired dimension of cutting as well as inhibiting the knives from pulling the food product off the conveyors prematurely. Each of the conveyors for the first and second slicing machines include a lower conveyor unit and an upper conveyor unit that cooperatively transport the food product into the knives. The upper conveyor unit is of the floating type that will adjust to the height of the product passing between the lower conveyor unit and the upper conveyor unit. The upper conveyor unit is biased to provide a downward force to ensure adequate gripping of the food product.

The gang of circular blades of the second slicing machine are adjustably movable as a unit to vary the tangential angle at which the peripheral cutting edges of gang of blades contact the food product as the product is fed into the blades. This accommodates the varying slicing properties as between different food products and aids in the manner in which the food product is fed into the gang of circular knives.

The cross cutting blades of the first and second slicing machine have improved geometric configurations to enable continuous feeding of the food product without the need of incremental stepping the conveyors.

Improved kick out plates are provided for the gang of circular knives. The kick out plates are configured to provide a guided travel path that inhibits the jamming or stacking up of cubes between adjacent blades of the gang of circular blades.

The above improvements will become more apparent upon reference to the following detailed description and drawings referred to therein.

DESCRIPTION OF THE PREFERRED EMBODIMENT

Figure 1:
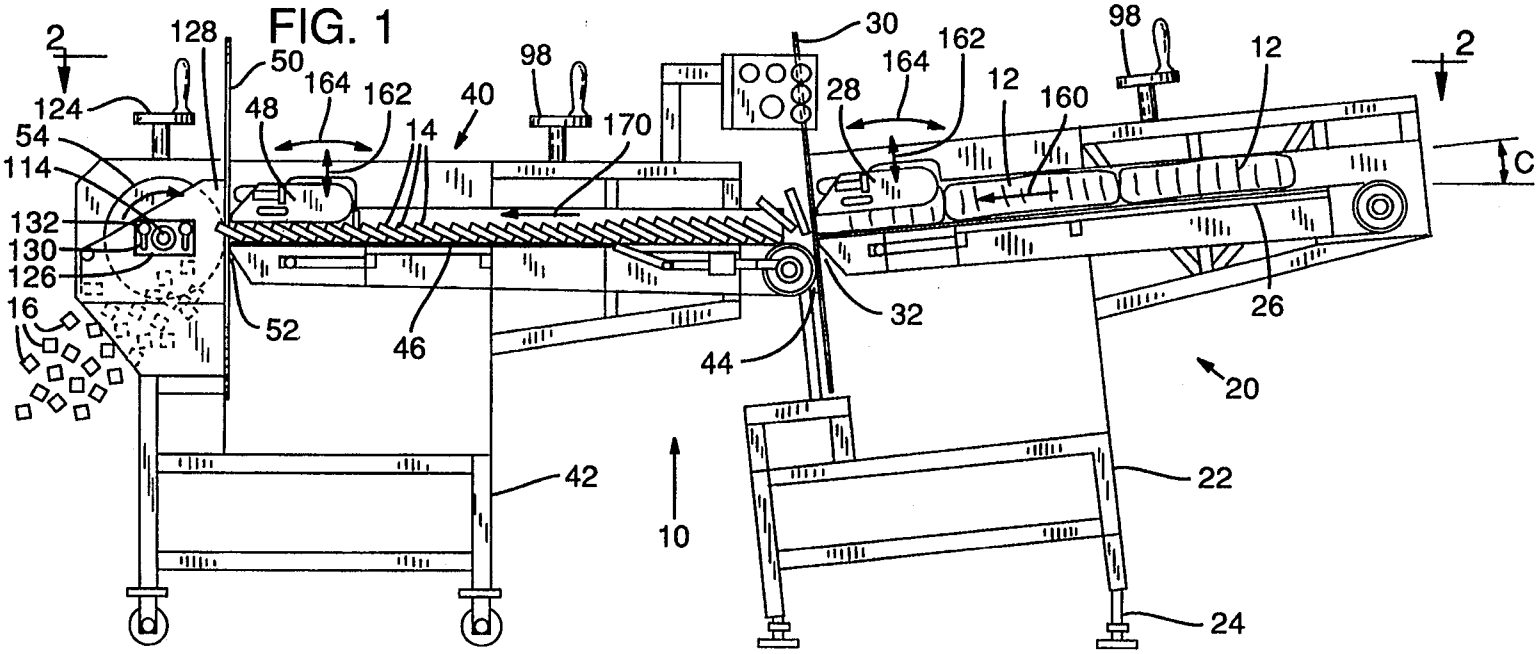
FIG. 1 is a front view of three dimensional slicing machine of the present invention.

Refer now to FIG. 1 of the drawings which illustrates a machine 10 for slicing in a single continuous operation a food product, such as a loaf 12 into cubes 16 having determined lengths, widths and heights.

For purposes of discussion, in this embodiment we will refer to a product to be sliced as a loaf 12. The products to be sliced include, but are not limited to, boneless food product items such as meats, fowl, fish, prepared meats such as sausages, formed roasts and the like. The loaf 12 can be considered to have three dimensions, length, width and height. The length of the loaf will be referred to as that dimension that extends along the travel direction of the conveyors of the machine, particularly the lower conveyor, the width of the loaf will be referred to as the dimension that is transverse to the travel direction of the conveyor and the height will be referred to as the distance that the loaf extends above the lower conveyor. The lower conveyors of the machine 10 of FIG. 1 are designated by numerals 26, 46. It will be appreciated, that the length, height and width dimensions are nominally measured and referred to since the dimensions of the products by nature or design vary from one to the other and in fact vary for a single item. A single loaf 12, for example may have varying widths along its length, may have varying heights along its length and across its width, and may have varying lengths across its width.

Figure 2:
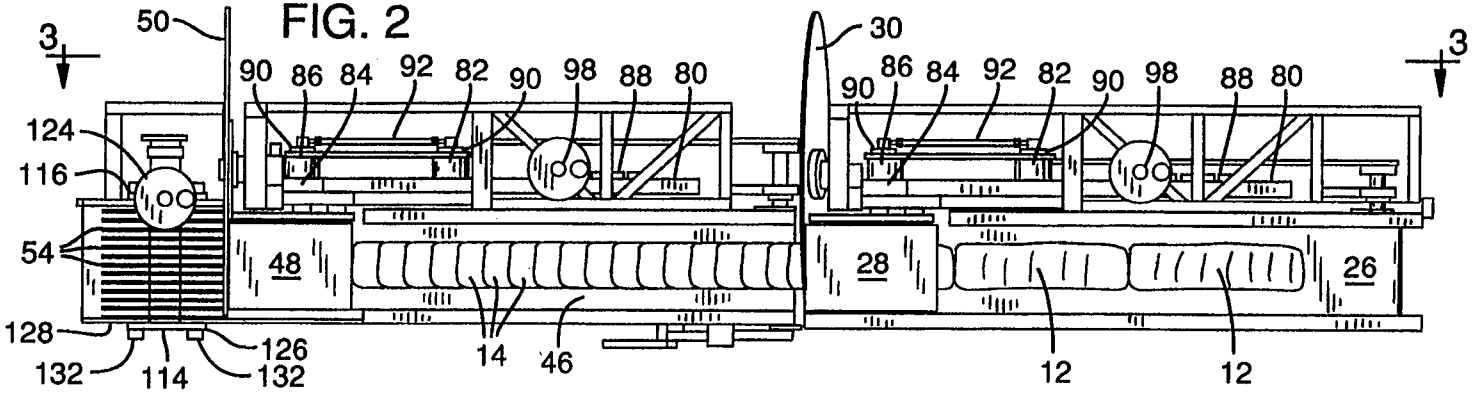
FIG. 2 is top view of the machine of the present invention as viewed on view lines 2—2 of FIG. 1.
Figure 3:
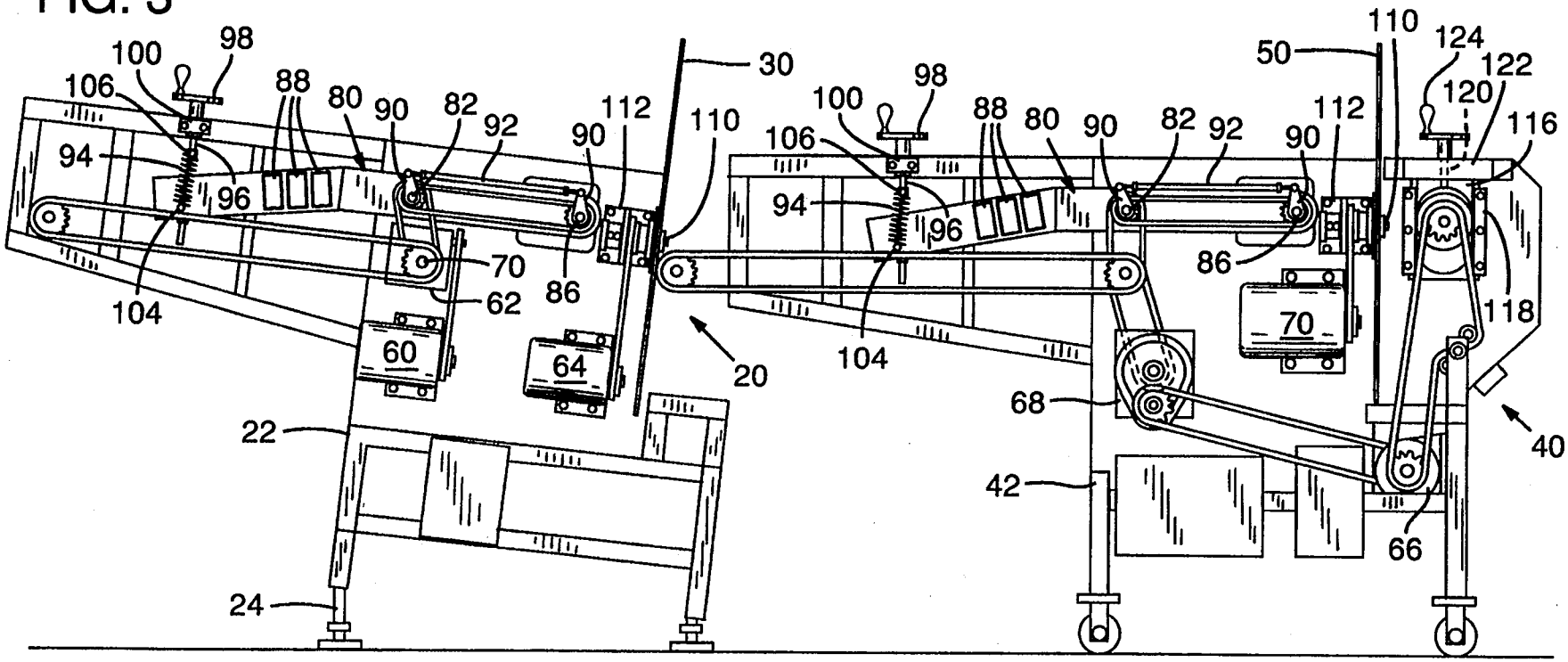
FIG. 3 is a rear view of the machine of the present invention as viewed on view lines 3—3 of FIG. 2.

The machine 10 in this embodiment as illustrated in FIGS. 1, 2 and 3 is an arrangement of two slicing machines, one, which will be referred to as a first slicing station 20, for slicing the loaf 12 into multiple slices or slabs 14 and a second machine which will be referred to as a second slicing station 40 for slicing the slabs 14 into multiple cubes 16. The slicing station 20 is supported on a stand (frame) 22 that is arranged with adjusting mechanisms 24, such as adjusting screws, to adjust the angle of inclination of the slicing station 20 and particularly the angle of inclination of a lower conveyor 26. The angle of inclination of the lower conveyor 26 is designated as angle C. The lower conveyor 26 is a belt type conveyor that is mounted on the stand 22 and is arranged to receive the loaf 12 of the product to be sliced. The slicing station 20 includes a floating upper belt type conveyor 28 that is positioned above and strategic to the lower conveyor 26. The conveyor 28 will adjust relative to the lower conveyor 26 to accommodate the height of the loaf 12 to be sliced. In addition to the floating capability, the upper conveyor 28 is tiltable relative to the lower conveyor 26 and is biased toward the lower conveyor 26 by an improved biasing arrangement. The details of the mounting and biasing arrangement of the upper conveyor will be explained later. An improved rotating cutoff knife 30 is rotatably mounted on the stand 22 strategic to the discharge end, generally indicated by numeral 32, of the lower and upper conveyors 26, 28. The slicing station 20 is positioned strategic to the slicing station 40 with the discharge end 32 of the conveyors 26, 28 being in close proximity to the end 44 of the lower conveyor 46 of the slicing station 40. The slicing station 40 is supported on a stand (frame) 42. The slicing station 40 has a lower conveyor 46 and an upper conveyor 48 arranged in the same manner as the lower and upper conveyors 26, 28 of the slicing station 20. The slicing station 40 has a cutoff knife 50 rotatably mounted on the frame 42 strategic to the exit end, generally indicated by numeral 52, of the conveyors 46, 48. The slicing station 40 has a gang of circular knives 54 rotatably and adjustably mounted on the frame 42 adjacent the exit end 52 of the conveyors 46, 48.

Refer now to FIG. 3 of the drawings which is a rear view of the machine 10 of FIG. 1. The rate at which the lower conveyor 26 and the upper conveyor 28 of the slicing station 20 are driven is variable. In this embodiment, an adjustable frequency drive for controlling motor 60 is provided to vary the rate at which the lower conveyor 26 and the upper conveyor 28 are driven. The drive motor 60 is coupled in a conventional manner to drive a gearbox 62 and an output shaft 70 of the gear box 62 is coupled in a conventional manner to drive the lower conveyor 26 and the upper conveyor 28 in unison. In this embodiment, known power transmitting devices such as gears, sprockets and drive chains are utilized to transmit the rotative power of the motor to the upper and lower conveyor via the gear box 62. The upper conveyor incorporates two gears in mesh in a known manner to rotate a drive roller of the upper conveyor counter to the rotation of the output shaft 70 of the gearbox 62. A variable speed motor 64 is provided to rotatively drive the knife 30 at a desired rate of rotation. Conventional power transmitting devices such as sprockets and chain are utilized to transmit the rotative power of the motor 64 to the knife 30. Separate motors are also utilized in the slicing station 40. A variable speed drive motor 66 is provided to drive the gang knives 54, the lower conveyor 46 and the upper conveyor 48. As shown, known conventional power transmitting devices such as chain and sprockets are utilized to transmit the rotative power of the motor 66 to the gang knives 54. The drive motor 66 is coupled to the lower conveyor 46 and upper conveyor 48 via a gearbox 68 and known chain, gears and sprockets. A variable speed drive motor 70 is provided for providing power to the cutoff knife 50 by utilizing known conventional devices such as chain and sprockets.

Still referring to FIG. 3, the upper conveyor 28 of the slicing station 20 as previously mentioned is adjustable relative to the lower conveyor 26 and may also be tilted in reference to the lower conveyor 26. A swing arm 80 pivotally mounted to the stand 22 on a shaft 82 is provided for adjusting the upper conveyor 28. The shaft 82 is fixedly attached to the stand 22. The swing arm 80 has a housing 84 (See FIG. 2) to receive a shaft 86 extending from the frame of the upper conveyor 28. The shaft 86 is fixedly attached to the frame of the upper conveyor 28 and is pivotally mounted in the housing 84. An arm 90 is fixedly attached to the end of the shaft 86 in a non rotative manner and a similar arm 90 is fixedly attached to the shaft 82 in a non rotative manner. A conventional turnbuckle 92 extends between the arms 90 with the ends of the turnbuckle 92 being pivotally mounted to the arms 90 in a conventional manner. The upper conveyor 28 mounted to the swing arm 80 is adjustable relative to the lower conveyor 26 by the pivoting movement of the swing arm 80. Additionally the angle of tilt of the upper conveyor 28 relative to the lower conveyor 26 may be adjusted by adjusting the turnbuckle 92 to either decrease the distance between the arms 90 or increase the distance between the arms. The weight of the upper conveyor 28 mounted on the swing arm 80 tends to force the upper conveyor 28 toward the lower conveyor 26. This is beneficial in feeding the loaf 12 between the upper conveyor 28 and the lower conveyor 26 yet it is desired to control the force applied to the loaf 12 by the upper conveyor 28. Weights 88 are provided on the swing arm 80 to offset the weight of the conveyor 28 and thus control the biasing force provided by the weight of the conveyor 28. The biasing force required will depend on the product to be sliced and the weights will be adjusted accordingly. An additional adjustable biasing force is provided by a spring 94 and an adjusting mechanism that controls the tension of the spring 94. An adjusting screw 96 having a handwheel 98 mounted on one end is threadably engaged with a bracket 100 affixed to the stand 22. One end of the spring 94 is attached to the swing arm 80 at 104 and the opposite end of the spring 94 is attached to the adjusting screw 96 at 106. Rotation of the handwheel 98 in one direction will thus increase the tension of the spring 94 which increases the force urging the upper conveyor 28 toward the lower conveyor 26 and rotation of the handwheel in the opposite direction will decrease the tension of the spring 94 which decreases the force urging the upper conveyor 28 toward the lower conveyor 26. The biasing force may thus be readily and easily adjusted to suit the requirements without interrupting the slicing cycle. The upper conveyor 48 of the slicing station 40 is mounted in the same manner.

Figure 4:
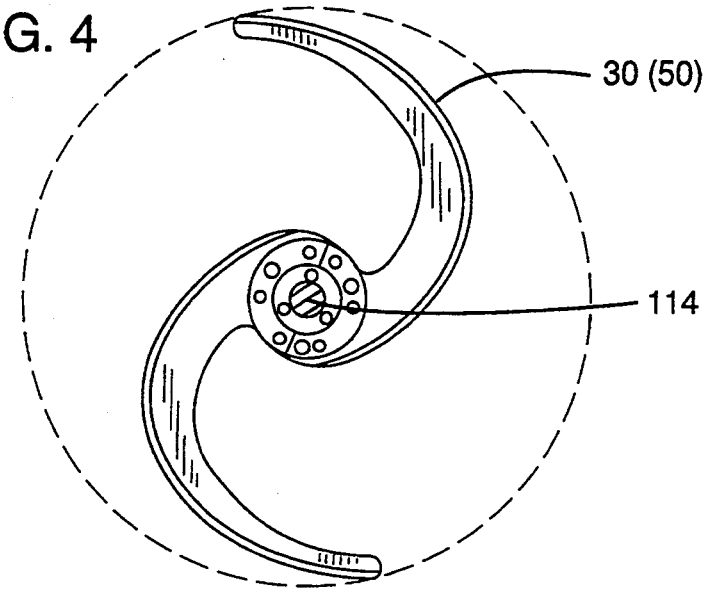
FIG. 4 is a view of an improved cut off knife of the machine of FIG. 1.

The cutoff knives 30 and 50 of the slicing station 20 and 40 are further illustrated in FIG. 4. As shown, the knives 30, 50 are double spiral (however, they may also be single spiral or triple spiral) and are configured to provide a true slicing action rather than a chopping action as the knives are rotated. As shown in FIG. 3, knife 30 is removably attached to a shaft 110 supported on a bracket 112 attached to the stand 22 of slicing station 20. Knife 50 is similarly removably mounted to a shaft 110 supported on a bracket 112 attached to the stand 42 of the slicing station 40. The thin section of the blades 30, 50 permits continuous feeding of the product to be sliced by the upper and lower conveyors of the slicing stations 20 and 40.

Figure 5A:
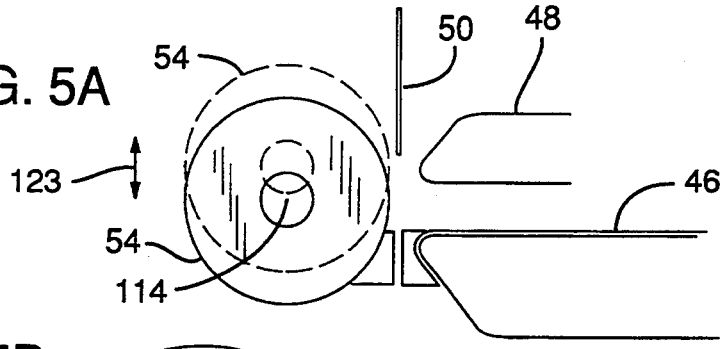
FIGS. 5A, 5B and 5C illustrate the adjustment of the gang knives of the machine of FIG. 1.
Figure 5B:
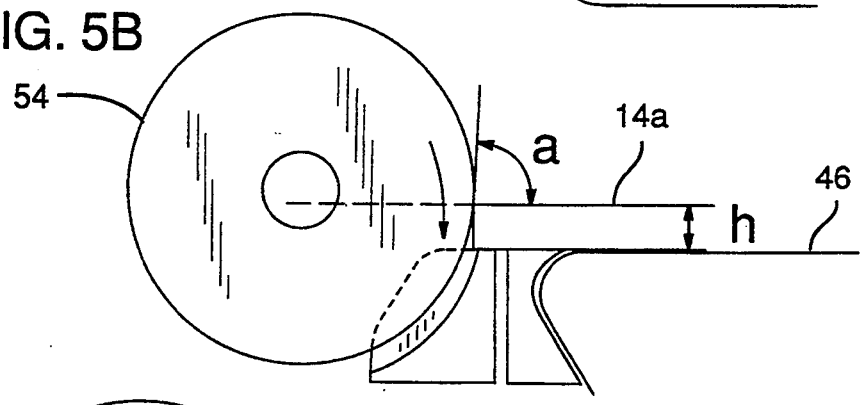
Figure 5C:
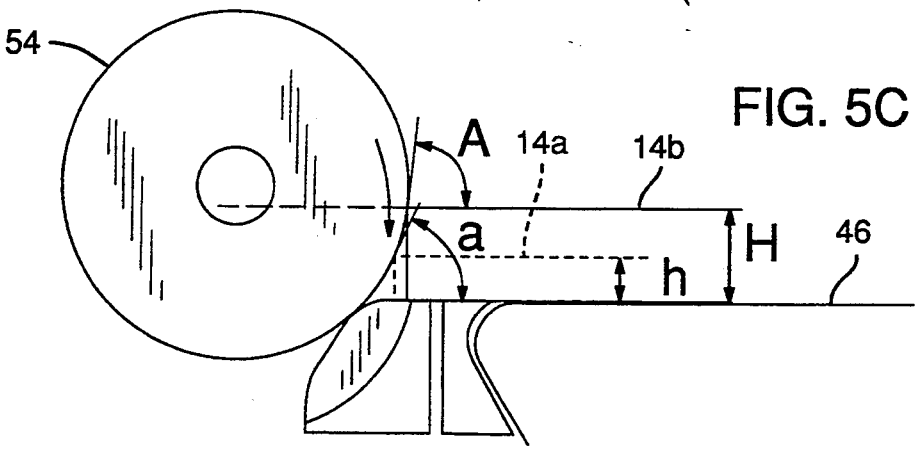

The gang knives 54 of the slicing station 40 are adjustably mounted on the stand 42 of the slicing station 40 as shown in FIGS. 1, 2 and 3 and further illustrated in FIGS. 5A, 5B, and 5C. The gang knives 54 are mounted on an arbor 114 in a spaced relation and the arbor is rotatively supported in a movable bracket 116. Guide ways 118 are provided on the stand 42 to support and guide the movable bracket 116. The position of the bracket 116 is adjusted by an adjusting screw 120. The adjusting screw 120 is rotatably attached to the bracket 116 and is threadably engaged with a bracket nut 122 affixed to the stand 42. A handwheel 124 is affixed to the screw 120 to facilitate rotating the screw to adjust the position of the bracket 116 and thus the position of the gang knives 54. The outboard end of the arbor 114 is supported in a bracket 126. The bracket 126 is adjustably mounted to a side plate 128 of the stand 42. The bracket 126 has slots 130 to facilitate adjusting the bracket 126 on the side plate 128 in accordance with the adjustment of the bracket 116. Fasteners 132 are provided to secure the bracket 126 in an adjusted position.

Refer now to FIGS. 5A, 5B and 5C of the drawings which show the adjustability of the gang knives 54. As illustrated, the gang knives are adjustable upwardly and downwardly as indicated by arrow 123 by being either elevated or lowered with respect to the lower conveyor 46. It is believed that the best conditions for producing a slice in a product, particularly a product having a reduced height, by the gang knives is attained when the approach angle is near normal. The approach angle is the angle as measured between the travel direction of the product to be sliced and a line tangent to the circular blades at the maximum height elevation of the product to be sliced. FIG. 5B shows the knives 54 lowered with respect to the top surface of the conveyor 46 to facilitate slicing a slab **14*a* having a height h. As seen, the approach angle a is near normal. FIG. 5C illustrates the knives 54 elevated to facilitate slicing a slab 14*b* having a height H. As seen the approach angle A is near normal. Slab 14*a* is superimposed in dashed lines in FIG. 5C and as can be seen the approach angle a is much less than normal. The more the approach angle deviates from normal, the greater the tendency for the knives 54 to pull the product to be sliced out of the grasp of the upper and lower conveyors 48, 46**.

Figure 6:
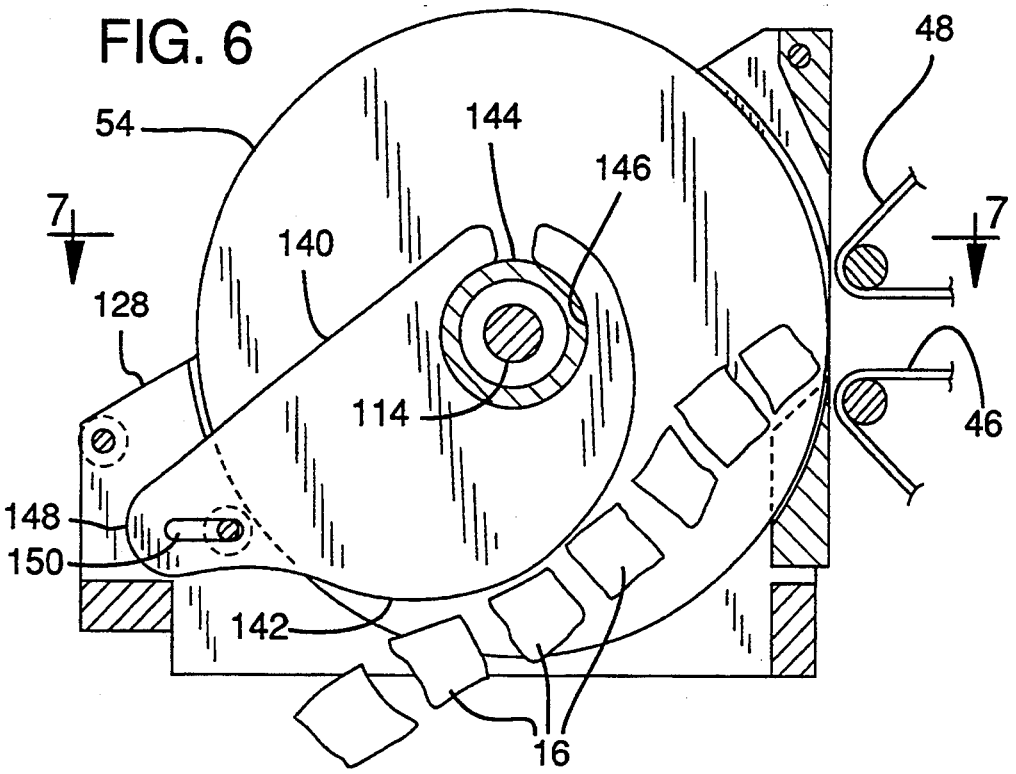
FIG. 6 is a view of an improved kick out plate of the machine of FIG. 1.

Refer now to FIG. 6. An improved product kick out plate 140 is mounted between adjacent knives 54 to facilitate discharging the cubes 16 produced from the gang knives 54. As shown, the plate 140 has a curved surface 142 which will gradually urge the cubes 16 to travel radially outward with respect to the knives 54. The plate is mounted on the spacer 144 separating adjacent knives 54, the plate 140 having a suitable bore 146 to accommodate the spacer 144. An end 148 of the plate 140 is fixedly attached to the frame 42 by a conventional fastener (not shown) fitting in a slot 150. The slot 150 is provided to accommodate the positional adjustment of the end 148 as the gang knives 54 are adjusted vertically upwardly or downwardly.

Figure 7:
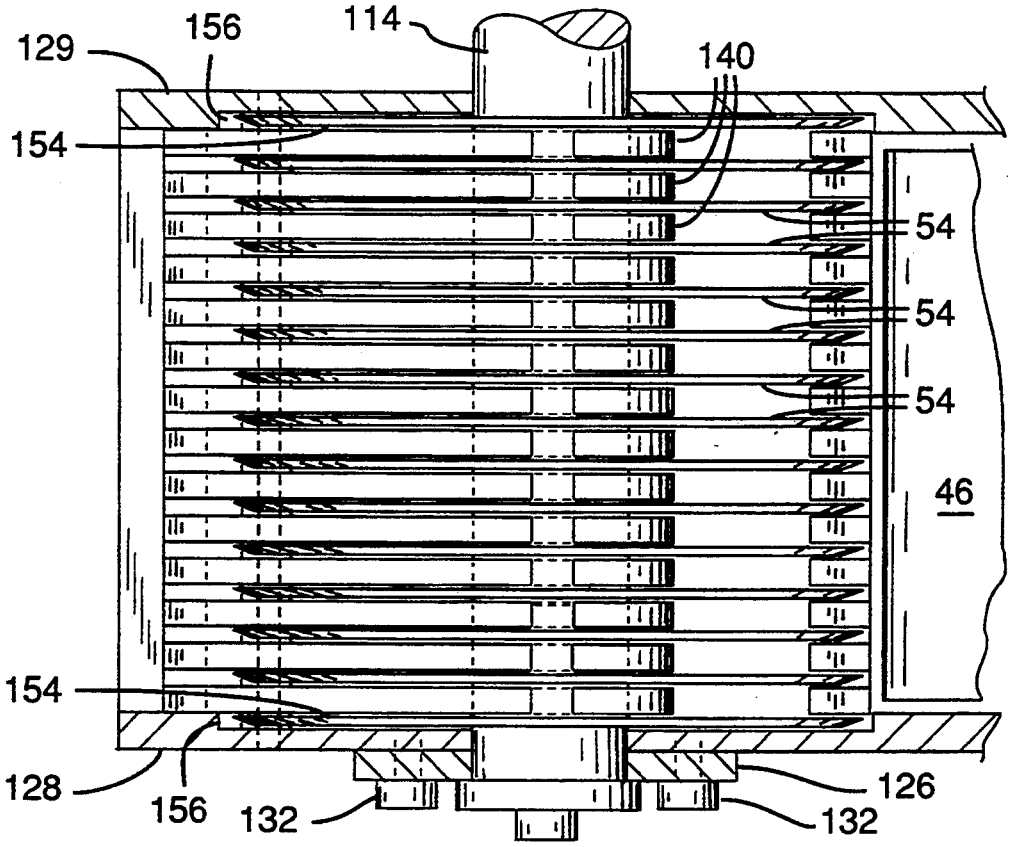
FIG. 7 is a view showing the relation of the side plates and the gang knives of the machine of FIG. 1.

Referring now to FIG. 7, the side plates 128 and 129 are preferably provided with recesses 156 to receive the end cutters 154 of the gang of cutters 54. The end cutters 154 are provided to facilitate the discharge of the cubes 16 from the outermost end spaces of the gang knives 54. The end cutters 154, in effect provide a rotating wall to aid in propelling the cubes 16 out of the end spaces of the gang of cutters 54.

Refer once again to FIGS. 1 and 2 of the drawings which illustrate the three dimensional slicing machine 10 of the present invention. The machine 10 is arranged to slice a product such as a loaf 12 in one continuous cycle into cubes 16 having determined dimensioned lengths, widths and heights. The machine 10 comprises a first slicing station 20 and a second slicing station 40.

The first slicing station 20 has a conveyor unit (a lower conveyor 26 in combination with an upper conveyor 28) for transporting a product (loaf 12) to be sliced into a travel path of a rotating cutoff knife (knife 30). The lower conveyor 26 is inclined at an angle C with respect to a horizontal plane. Products to be sliced are sequentially received on the lower conveyor 26 of the first slicing station 20. For purposes of illustration and discussion a single loaf 12 and components thereof will be referred to. The loaf 12 received on the lower conveyor 26 is transported in the direction indicated by arrow 160. As the loaf 12 encounters the upper conveyor 28, the upper conveyor will adjust to the height of the loaf 12. The upper conveyor 28 is adjustable relative to the lower conveyor 26 as indicated by the bi-directional arrow 162. As previously stated, the upper conveyor 28 is biased toward the lower conveyor by a system of weights and a biasing spring. The loaf 12 will thus be held captive between the upper and lower conveyor and will move in the direction indicated by arrow 160 only upon the unified movement of the upper and lower conveyors. The loaf 12 is transported (conveyed) by the upper conveyor 28 and the lower conveyor 26 into the travel path of the rotating cut off knife 30. The knife 30 will slice (cut off) a slab (slice) 14 from the loaf 12. The slab 14 will tip on to the lower conveyor 46 of the slicing station 40. The loaf 12 being inclined at the same angle C as the lower conveyor 26 promotes the tipping of the slab 14 on to the lower conveyor 46 of the slicing station 40 due at least in part to gravity. As previously stated, the rate at which the conveyor unit (upper and lower conveyor 26, 28) and the knife 30 are driven are driven may be independently varied. The rates are adjusted to produce a slab 14 having a desired length (thickness). Recall that length is measured along the travel direction. The slab 14 being tipped on to the lower conveyor 46 now has a determined height as a result of the knife 30 slicing a determined length of slab 14 off the loaf 12. The slabs 14 are shown being placed on the lower conveyor 46 of the slicing station 40 in an overlapping or "shingled" manner. This is just one example and it will be appreciated that the slabs 14 may be placed sequentially on the conveyor 46 in an end to end arrangement with or without spacings therebetween by appropriately adjusting the feed rates of the conveyor units of the stations 20 and 40 in conjunction with the rates of the cut off knives 30 and 50. The slabs 14 received on the lower conveyor 46 are conveyed toward the gang knives 54 as indicated by arrow 170. The slabs 14 will enter between the upper and lower conveyors 46, 48, the upper conveyor 48 adjusting to the height of the stacked slabs 14. The slabs 14 are thus held captive and conveyed between the upper and lower conveyors 46, 48 and are transported toward the gang knives 54 only by the unified movement of the upper and lower conveyors 46, 48. The slabs 14 are fed into the gang knives 54 where multiple cuts are made in each slab 14 thus establishing the determined width of the cubes 16. When the slabs 14 have been fed into the knives 54 a determined distance, the cut off knife 50 slices each slab 14 transversely to establish the length of the cube 16. The rate of rotation of the knife 50 and the feed rate of the conveyor unit (upper and lower conveyors 48, 46) are varied to establish the desired length of the cube 16. The cubes 16 are discharged from the gang knives 54 into a known receptacle or other conveyance means. The curved kick out plate 140 facilitates ejecting the cubes 16 from the knives 54.

The machine 10 has a conveyance system arranged to be variably driven in cooperation with variably driven cut off knives to produce end products (cubes 16) having uniformity of size and shape. The conveyance system of the machine 10 can be considered to comprise the upper and lower conveyors 28, 26 of slicing station 20, the upper and lower conveyors 48, 46 of slicing station 40 and the gang knives 54 in combination with the kick out plate 140.

The machine 10 is thus arranged to slice a food product (loaf 12) into an end product (cubes 16) in one continuous cycle.

It will be appreciated that the slicing station 20 may be utilized as a stand alone unit to provide one dimensional slicing of a food product. The slicing station 40 may also be operated as a stand alone unit to provide two dimensional slicing of a food product.

Those skilled in the art will recognize that modifications and variations may be made without departing from the true spirit and scope of the invention. The invention is therefore not to be limited to the embodiments described and illustrated, but is to be determined from the appended claims.

What is claimed is:

1. An automatic food slicing apparatus wherein the food product to be sliced is in the form of loaves and said loaves are to be sliced in three dimensions including length, height and width, to produce cubes, said food slicing apparatus comprising:

a first slicing station, a second slicing station, a first conveyor conveying food product loaves into the first slicing station whereat the food product loaves are sliced into slabs, and a second conveyor adjacent the first slicing station conveying the slabs from said first slicing station into the second slicing station whereat the slabs are sliced into cubes;

said first slicing station including a first cutoff knife that slices the loaves into slabs of a specified length, and further including apparatus for laying the slabs over onto the second conveyor with the specified length of the slabs as cut off by the first cutoff knife converted to the height dimension of the slabs as oriented on the second conveyor; and said second slicing station including an arrangement of gang blades for cutting the slabs into specified widths and a second cutoff knife for cutting the slabs into specified lengths.

2. A food slicing apparatus as defined in claim 1 wherein the apparatus for laying the slabs over includes an arrangement of the first cutoff knife oriented at an angle relative to horizontal to cut slabs at an angle to horizontal and to induce the slabs to lay over onto the second conveyor due to gravity.

3. An automatic food slicing apparatus as defined in claim 1 wherein the first and second cutoff knives are designed to cut through the loaves and slabs, respectively, while the first and second conveyors are in the process of conveying the loaves and the slabs with the movement of the food product through the cutoff knives being continuous.

4. An automatic food slicing apparatus as defined in claim 3 wherein the first and second conveyors define a path of conveyance for the food product, said cutoff blades being elongated blades that are thin and narrow relative to their length and configured in a spiral, said blades being rotatably mounted adjacent the path of conveyance and being rotated through the path of conveyance to slice the food product to length.

5. An automatic food slicing apparatus as defined in claim 1 wherein the first and second conveyors each include a lower conveyor belt and an upper conveyor belt, said upper conveyor belt mounted on an adjustable support that adjusts to the height of the food product, said upper and lower conveyor belts cooperatively gripping the product to facilitate proper feeding of the food product through the slicing stations for cutting the food product to the desired length.

6. An automatic food slicing apparatus as defined in claim 5 wherein the adjustable support includes pressure applying means for applying a downward pressure onto the food product, said pressure applying means being adjustable to adjust the downward pressure as needed to adapt to different kinds of food products.

7. An automatic food slicing apparatus as defined in claim 6 wherein the pressure applying means includes a biasing spring attached to an adjusting screw whereby alternate turning of the screw decreases and increases the pressure applied by the upper conveyor against the food product.

8. An automatic food slicing apparatus as defined in claim 1 wherein the gang blades are mounted on a common arbor and are spaced apart as required to cut the food product slabs into the specified widths, said arbor mounted for vertical adjustment to adjust the height of entry of the food product into the blades.

9. An automatic food slicing apparatus as defined in claim 1 wherein the gang blades are mounted on a common arbor between side supporting plates, said gang blades including end blades adjacent the side plates, said side plates being recessed for receiving the end blades and preventing food product from entering between the end blades and the side plates.

10. An automatic food slicing apparatus as defined in claim 1 wherein the gang blades are designed to convey the cubes of food product down and forward of the second slicing station, and a fixed kick out plate mounted between each pair of blades to force the product cubes out of the gang blades, said kick out plate configured with a rearward edge that is curved relative to the path of the food product cubes being carried by the blades to function as a ramp to ramp the cubes from between the blades.

11. An automatic food slicing apparatus as defined in claim 1 wherein gang blades are arranged at one of said first and second slicing stations for cutting the slabs into determined widths.

* * * * *